US012077897B2

(12) United States Patent
Pavanello

(10) Patent No.: US 12,077,897 B2
(45) Date of Patent: Sep. 3, 2024

(54) SAFETY VALVE ASSEMBLY FOR WATER INLET HOSES OF WASHING MACHINES AND DISHWASHERS

(71) Applicant: PAVANELLO S.R.L., Carnago (IT)

(72) Inventor: Emanuele Pavanello, Carnago (IT)

( * ) Notice: Subject to any disclaimer, the term of this patent is extended or adjusted under 35 U.S.C. 154(b) by 0 days.

(21) Appl. No.: 18/557,937

(22) PCT Filed: May 11, 2022

(86) PCT No.: PCT/IB2022/054375
§ 371 (c)(1),
(2) Date: Oct. 29, 2023

(87) PCT Pub. No.: WO2022/238920
PCT Pub. Date: Nov. 17, 2022

(65) Prior Publication Data

US 2024/0229334 A1 Jul. 11, 2024

(30) Foreign Application Priority Data

May 12, 2021 (IT) ..... 102021000012146
May 3, 2022 (IT) ..... 102022000008966

(51) Int. Cl.
*D06F 39/08* (2006.01)
*A47L 15/42* (2006.01)

(52) U.S. Cl.
CPC ..... *D06F 39/081* (2013.01); *A47L 15/4217* (2013.01)

(58) Field of Classification Search
CPC ..... D06F 39/081; A47L 15/4217
See application file for complete search history.

(56) References Cited

U.S. PATENT DOCUMENTS 3,097,762 A * 7/1963 Charnota ..... A01G 25/165 222/518
4,023,708 A * 5/1977 Fornasari ..... D06F 39/081 222/20

(Continued)

FOREIGN PATENT DOCUMENTS

EP 1798326 A1 6/2007
EP 3553222 A1 10/2019

(Continued)

OTHER PUBLICATIONS

ISR; European Patent Office; Aug. 11, 2022.

*Primary Examiner* — Patrick C Williams
(74) *Attorney, Agent, or Firm* — Patshegen IP; Moshe Pinchas

(57) ABSTRACT

A safety valve assembly for water inlet hoses of washing machines and dishwashers, of the type comprising a valve body (20) formed by an upper half-shell (91) and a lower half-shell (92), an inner shank (29) equipped with an upper part (29*a*) provided at a ring nut (14) for fixing to the water inlet faucet and a lower valve guide (4), wherein an axial chamber (21) is formed between the lower valve guide (4) and said shank (29) and wherein an annular chamber (22) is formed between the shank (29) and said half-shells (91,92), a membrane (3) being provided to divide said annular chamber (22) into an upper compartment (22*b*) and a lower compartment (22*a*), characterized in that it further comprises a filter (12) arranged at said upper portion (29*a*) of the shank (29), coupled by interlocking to a respective upper valve guide (18).

7 Claims, 7 Drawing Sheets

(56) References Cited

U.S. PATENT DOCUMENTS

| | | | | |
|---|---|---|---|---|
| 7,353,844 | B2 * | 4/2008 | Da Pont | A47L 15/4217 251/30.01 |
| 2011/0036436 | A1 | 2/2011 | Haltmayer | |
| 2018/0273399 | A1 | 9/2018 | Gaj et al. | |
| 2020/0232150 | A1 * | 7/2020 | Savini | A47L 15/421 |

FOREIGN PATENT DOCUMENTS

| | | | |
|---|---|---|---|
| IT | 2017 0002 6951 | A1 | 9/2018 |
| WO | 2020012517 | A1 | 1/2020 |

* cited by examiner

SAFETY VALVE ASSEMBLY FOR WATER INLET HOSES OF WASHING MACHINES AND DISHWASHERS

BACKGROUND OF THE INVENTION

The present invention relates to an improved safety valve assembly for water inlet hoses of washing machines and dishwashers.

As is known, the inlet hose of a washing machine or dishwasher is generally equipped with a safety device adapted to block the water flow in the event of a leak from the hose.

A typical known safety device generally comprises a valve assembly applied to the water inlet faucet and a corrugated sheath which covers the inlet hose and which is hermetically closed on the valve assembly and on the fitting which is applied to the household appliance.

In the event of a water leak from the inlet hose, due to the hose being cut or broken, the pressure generated in the gap or cavity between the hose and the sheath activates a mechanism that closes a valve and interrupts the flow from the faucet to the hose.

Known safety devices have the drawback of being somewhat bulky and tend to protrude laterally, and asymmetrically, with respect to the hose-sheath.

This drawback is caused by the type of mechanism used to operate the valve. Furthermore, with the mechanism of the known systems in the rest position, i.e. that of normal operation, the water flow rate is considerably lower than in a hose without this device.

Another drawback of known safety devices is due to the fact that the mechanism cannot intervene while the water is still flowing.

The drawbacks described above have been brilliantly overcome by means of a safety valve assembly described in patent application IT201700026951A1, in the name of this same Applicant.

SUMMARY OF THE INVENTION

The aim of the present invention is to provide a valve assembly which is improved compared to the systems of the prior art described above and which is more compact and functionally superior.

Another object of the invention is to provide a valve assembly which can be made with a small number of components, facilitating the production process.

A further object of the invention is to provide a valve assembly equipped with a new and advantageous filter fixing system.

Another object of the invention is to provide a valve assembly equipped with a non-return valve.

A further object of the invention is to provide a valve assembly in which, with the mechanism in rest condition, i.e. in the regular use position, the water flow rate is higher than in the safety devices of the known type.

Another object of the invention is to provide a valve assembly equipped with a mechanism of a type that, when it intervenes, can block the water flow even while water is still flowing, which is not possible with the known devices.

A further object of the invention is to provide a valve assembly in which the intervention of the mechanism is repeatable, thereby providing the possibility of testing completely (100%) the valve assembly.

Another object of the invention is to provide a valve assembly constructed with a smaller number of components than in the known devices and which is therefore also cheaper.

A further object of the invention is to provide a valve assembly, the assembly of which is simpler than the known devices, thus allowing a less complicated automation and therefore more economical in terms of production.

A further object of the present invention is to provide a valve assembly that, due to its particular construction characteristics, is extremely reliable and safe in operation.

These and other objects are accomplished through the valve assembly of claim 1. Preferred embodiments of the invention will be apparent from the remaining claims.

BRIEF DESCRIPTION OF THE DRAWINGS

Further characteristics and advantages of the present invention will become particularly apparent from an examination of the description of a preferred but not exclusive embodiment of the invention, illustrated by way of non-limiting example in the appended drawings, in which.

DETAILED DESCRIPTION OF THE PREFERRED EMBODIMENTS

Figure 1:
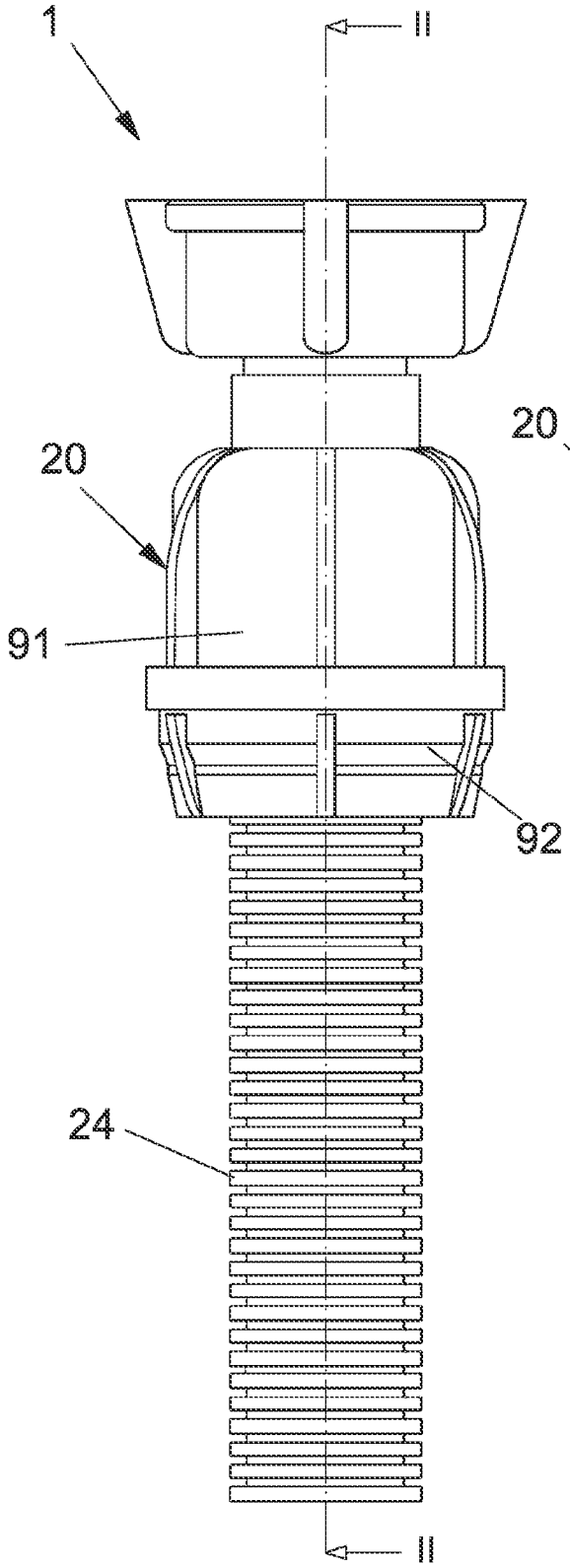
FIG. 1 is an elevation view of the valve assembly according to the present invention.
Figure 3:
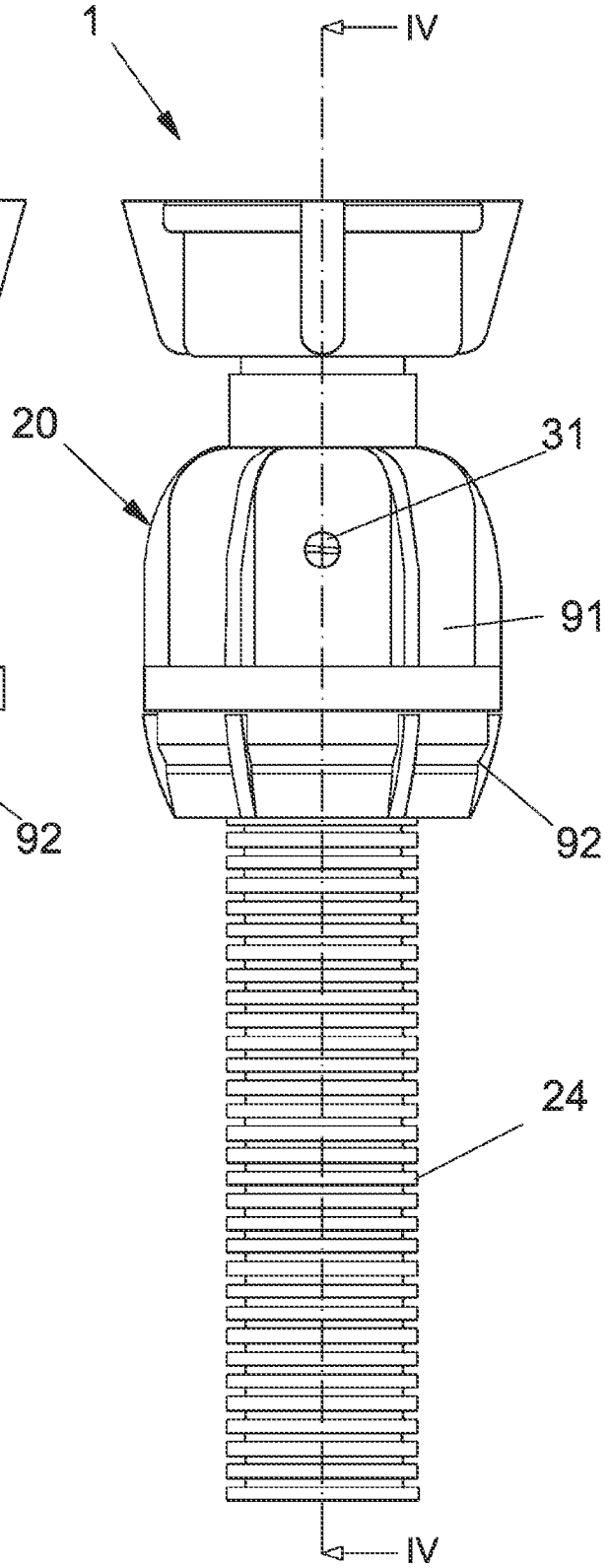
FIG. 3 is an elevation view, rotated by 90° with respect to FIG. 1, of the valve assembly.

With particular reference to the numerical symbols of the aforementioned figures, the valve assembly according to the invention, indicated as a whole with the reference number 1, comprises an enclosure or container body formed by a valve body 20 associated with a valve shell composed of an upper half-shell 91 and a lower half-shell 92.

The body 20 and the shell together define an axial chamber 21 and an annular chamber 22, coaxial and external to the axial chamber 21, in turn composed of a lower chamber 22*a* and an upper chamber 22*b*.

The axial chamber 21 is put in communication with the delivery mouth of a faucet to which the valve body 20 is fixed by means of a ring nut 14 with the interposition of a filter 12 and a gasket 13. According to the invention, the filter 12 is coupled to a respective support 18, acting as an upper valve guide.

A corrugated sheath 24 is associated with the lower shell 92 of the valve body 20 and with a water inlet hose 27.

According to the invention, the corrugated sheath 24 is hermetically fixed to the lower half-shell 92, through a process of injection of plastic material 50 (FIGS. 4 and 6), advantageously polypropylene, with a suitable co-molding mold, by welding the two components so that they become a single piece.

Figure 2:
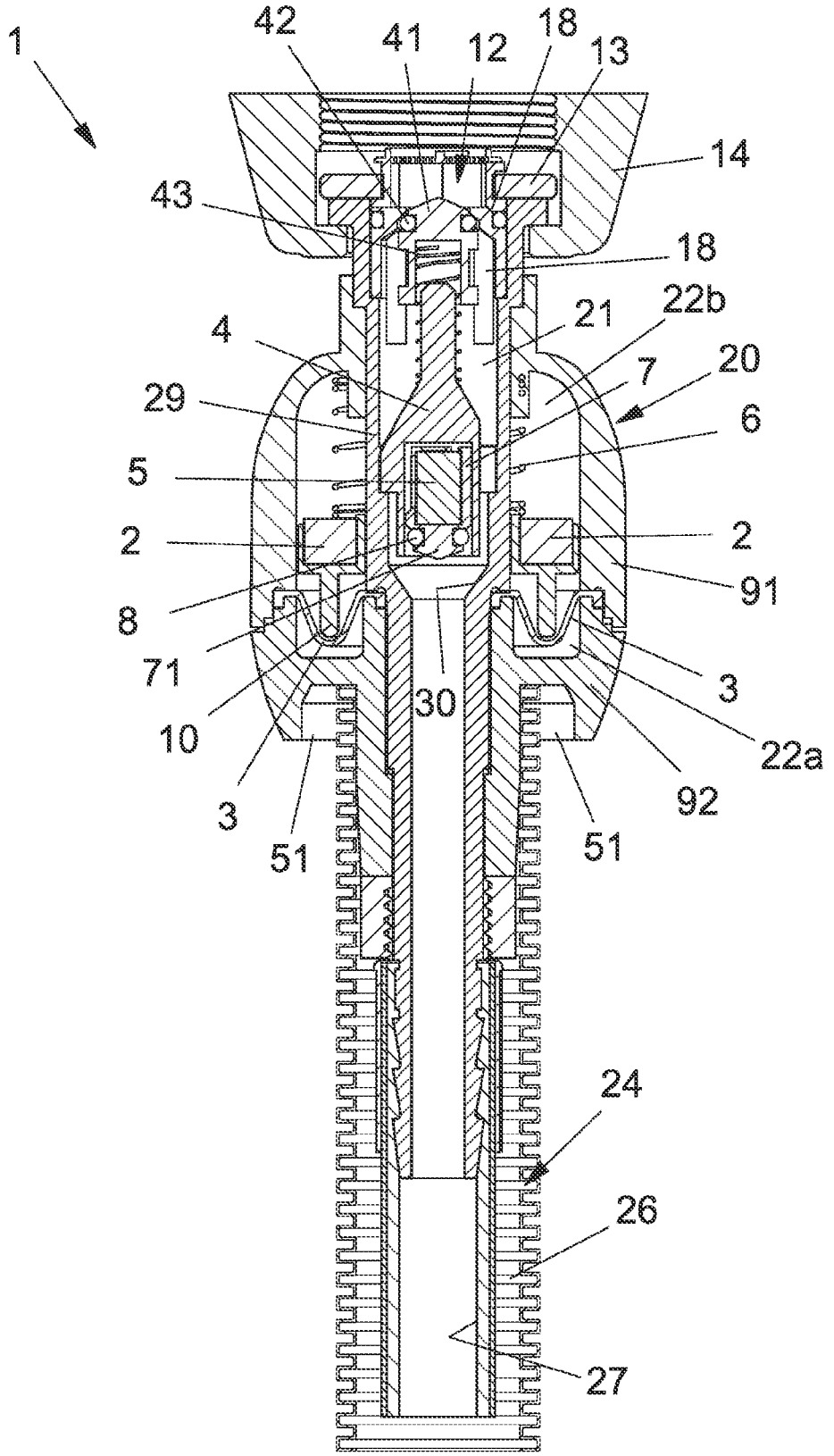
FIG. 2 is an elevation view, sectioned along the plane II-II of FIG. 1, illustrating the valve assembly in the normal use condition, in which the flow of liquid is free to enter the inlet hose.

In particular, the described injection of plastic material 50 fills the interstices 51 illustrated in FIG. 2, formed between the outer surface of the sheath 24 and the inner wall of the lower half-shell 92 of the valve body 20.

Advantageously, the corrugated sheath 24 is made of 100% polypropylene, whereas the lower shell 92 is made of 70% polypropylene and 30% fiber. The water inlet hose 27 is put in communication with the axial chamber 21 of the valve body 20. Furthermore, between the outer surface of the hose 27 and the inner surface of the corrugated sheath 24 a gap or cavity 26 is formed, which is put in communication with the lower portion 22*a* of the annular chamber 22 through holes 28 for the passage of fluid, formed in the lower half-shell 92 of the valve body 20.

Inside the annular chamber 22 there is an annular magnet 2 housed in an annular support 10 and axially movable in opposition to a spring 6, due to the thrust of a membrane 3, which is arranged in the side of the annular chamber 22 in communication with the holes 28.

The spring 6 is mounted coaxially with an inner shank 29 of the valve body 20. The inner shank 29 of the valve body 20 defines, internally, the axial chamber 21 and, externally, the annular chamber 22.

In particular, the membrane 3 divides the annular chamber 22 into two separate compartments: the lower one 22*a* which is in communication with the gap 26 through holes 28 for the passage of fluid, and an upper one 22*b* equipped with a transparent window 31 through which the raised position of the support 10 of the magnet 2 can be seen.

In the axial chamber 21, inside the shank 29 there is a plug 7 which slides axially and has a mushroom head 71 capable of closing the passage of fluid in the axial chamber 21, at a narrowing defined by an inclined surface 30 of the axial chamber 21 itself (FIG. 2). For this purpose, the mushroom head 71 defines an annular slot in which an O-ring 8 is housed.

A cylindrical magnet 5 is housed in the body of the plug 7, the latter being slidingly arranged inside the chamber 52 of the valve guide 4.

Figure 7:
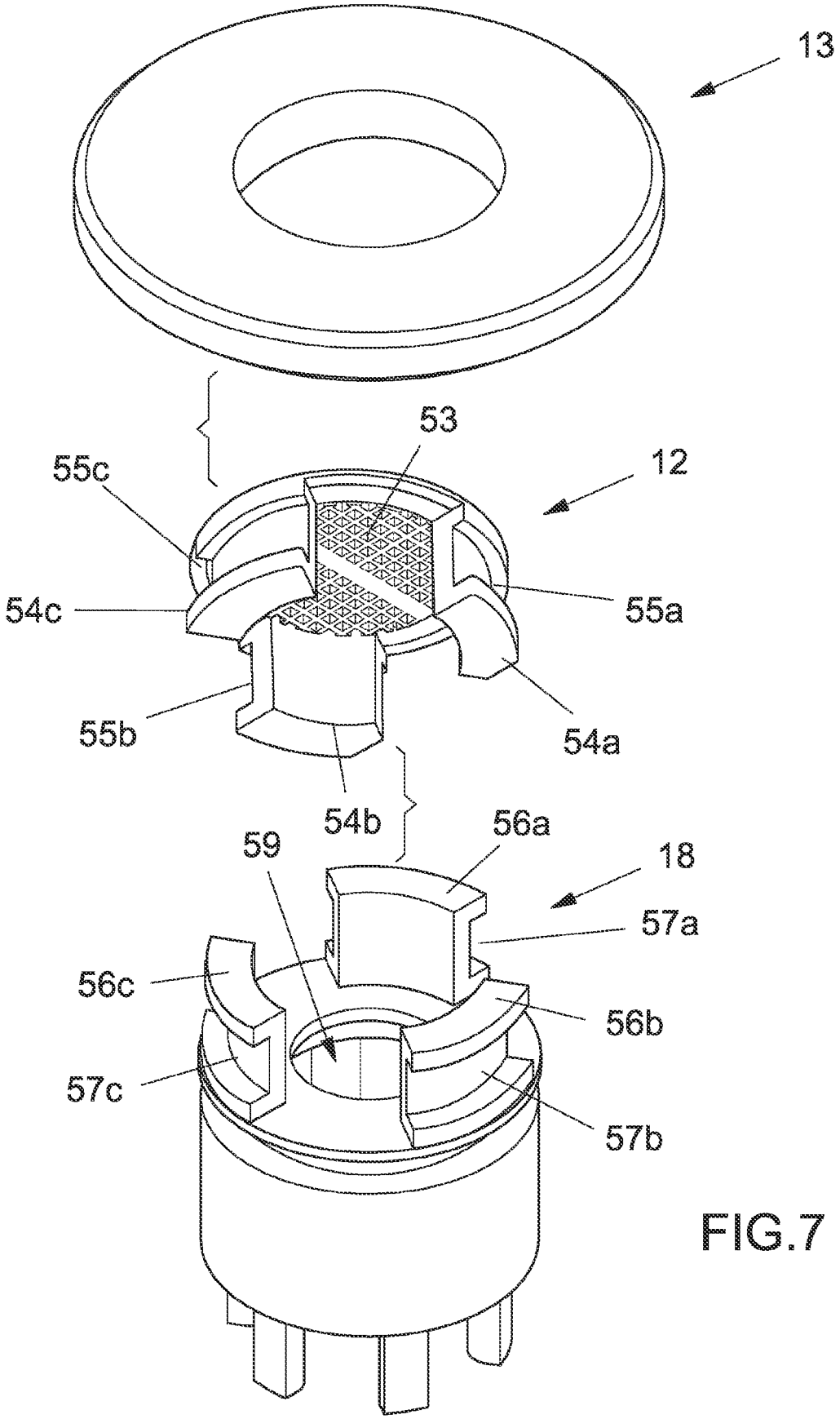
FIG. 7 is an exploded view of the coupling of the filter to the upper valve guide of the valve assembly of the previous figures.
Figure 8:
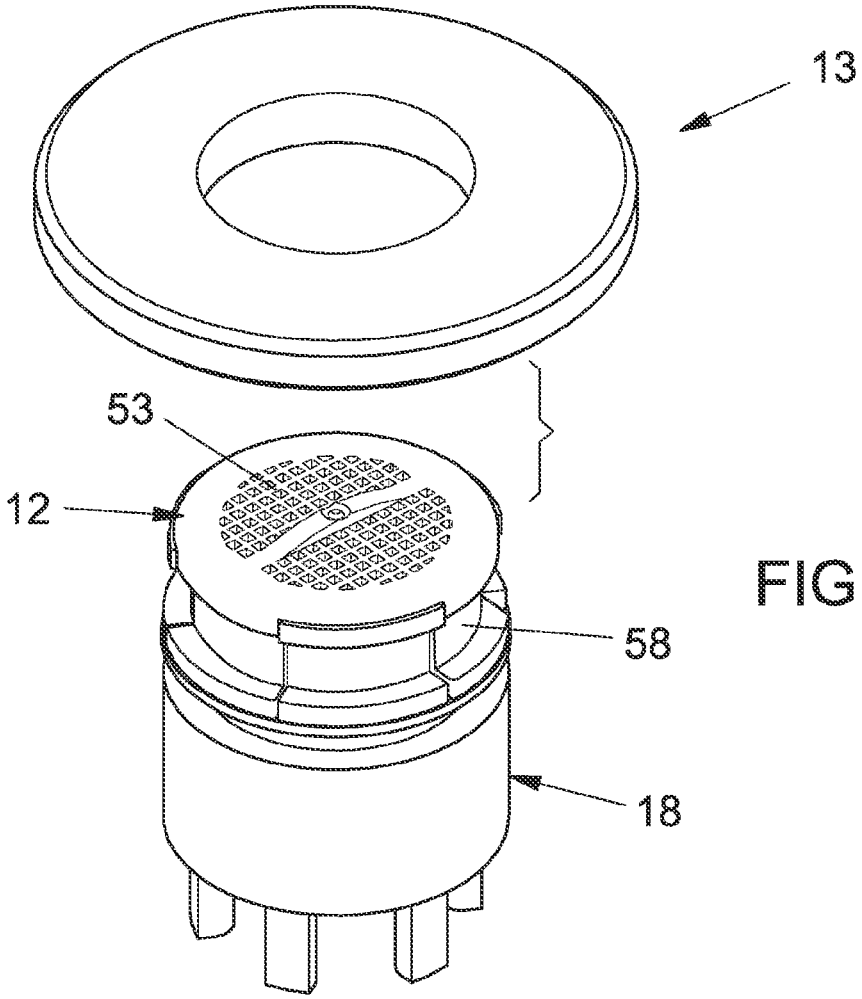
FIG. 8 illustrates the filter coupled to the valve guide of FIG. 7, with the gasket in exploded view.

The valve assembly 1 of the invention is equipped, at the upper portion 29*a* of the water inlet shank 29, with a filter 12 which is bayonet-coupled to an upper valve guide 18 (FIG. 7).

In particular, the filter 12 has a filtering wall 53 from which feet 54*a*, 54*b*, 54*c* protrude in the axial direction, each of which has a respective seat 55*a*, 55*b*, 55*c* intended to form the slot 58 for housing the flat gasket 13.

For its part, the upper valve guide 18, at its attachment to the filter 12, has feet 56*a*, 56*b*, 56*c* also having seats 57*a*, 57*b*, 57*c*.

Figure 9:
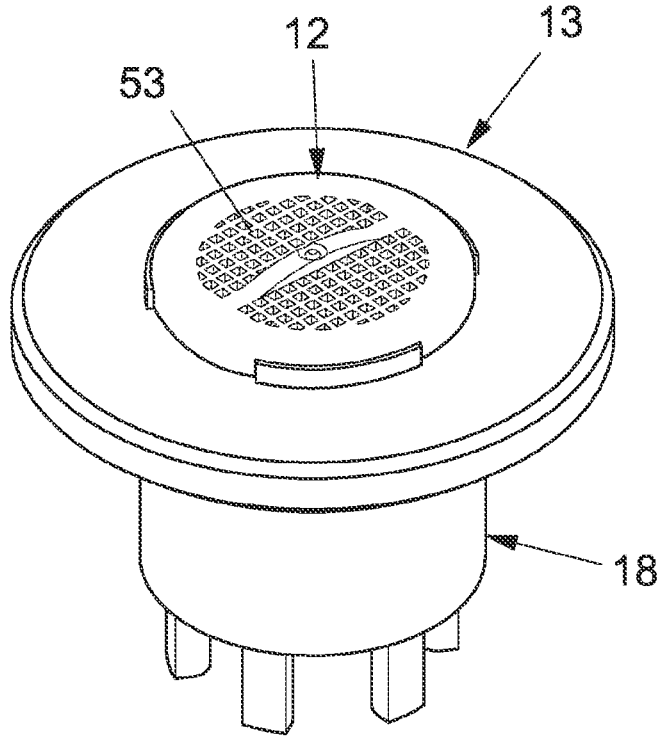
FIG. 9 illustrates the filter of FIG. 8, with the gasket assembled.

In the condition of the filter 12 assembled on the valve guide 18, the feet 54*a*, 54*b*, 54*c* of the filter 12 are arranged between the corresponding feet 56*a*, 56*b*, 56*c* of the valve guide 18, forming together with these a continuous annular slot 58 which receives the flat gasket 13, which in turn assembles the filter 12 and the valve guide 18 together in the condition shown in FIG. 9. In this way, the filter 12, the valve guide 18 and the gasket 13 form a single body which can be inserted by interlocking in the upper part 29*a* of the shank 29 for the inlet of water into the valve assembly.

The valve assembly of the invention further comprises, on the same part 29*a* of the shank 29, a non-return valve having a plug 41 which closes on the mouth 59 of the water inlet valve guide 18. For this purpose, a spring 43 is provided to push the plug 41 into the closing position of the mouth 59, also by means of an O-ring 42. This prevents water and air from leaking from the hose 27.

The action of the spring 43 is overcome by the pressure of the incoming water, thus allowing it to enter the hose 27.

The operation of the safety valve assembly 1 according to the present invention is as follows.

Figure 4:
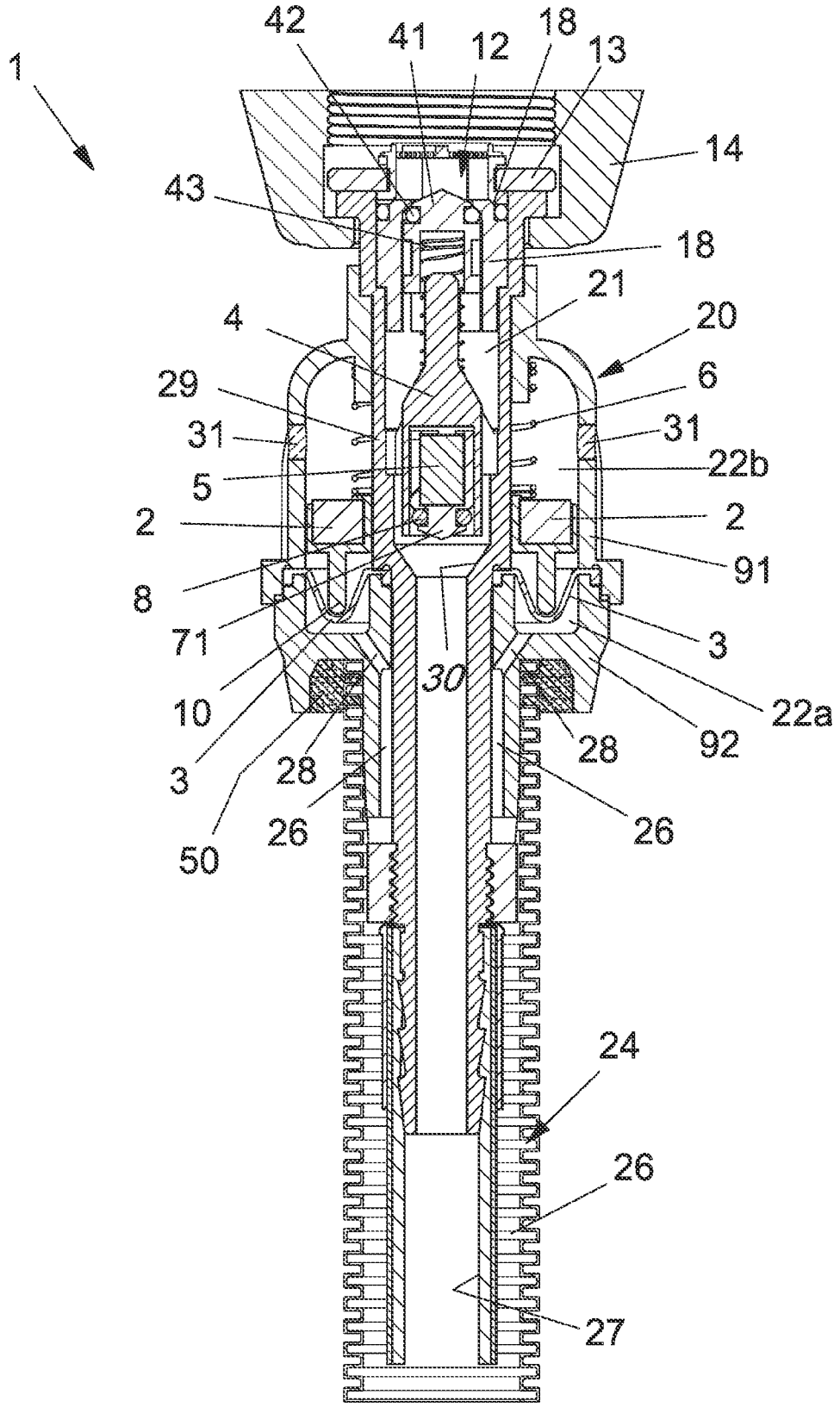
FIG. 4 is an elevation view, sectioned along the plane IV-IV of FIG. 3, illustrating the valve assembly in the normal use condition, in which the flow of liquid is free to enter the inlet hose.

With the mechanism in the rest position, i.e. normal operation condition, shown in FIGS. 2 and 4, the spring 6 keeps the annular magnet 2 and consequently also the annular support 10, in the end of stroke position against the membrane 3.

In this position the circular magnet 2, exploiting the opposing magnetic field, pushes the cylindrical magnet 5, which is integral with the mushroom-head plug 7, inside the valve guide 4, allowing the water flow to pass freely into the hose 27.

Figure 5:
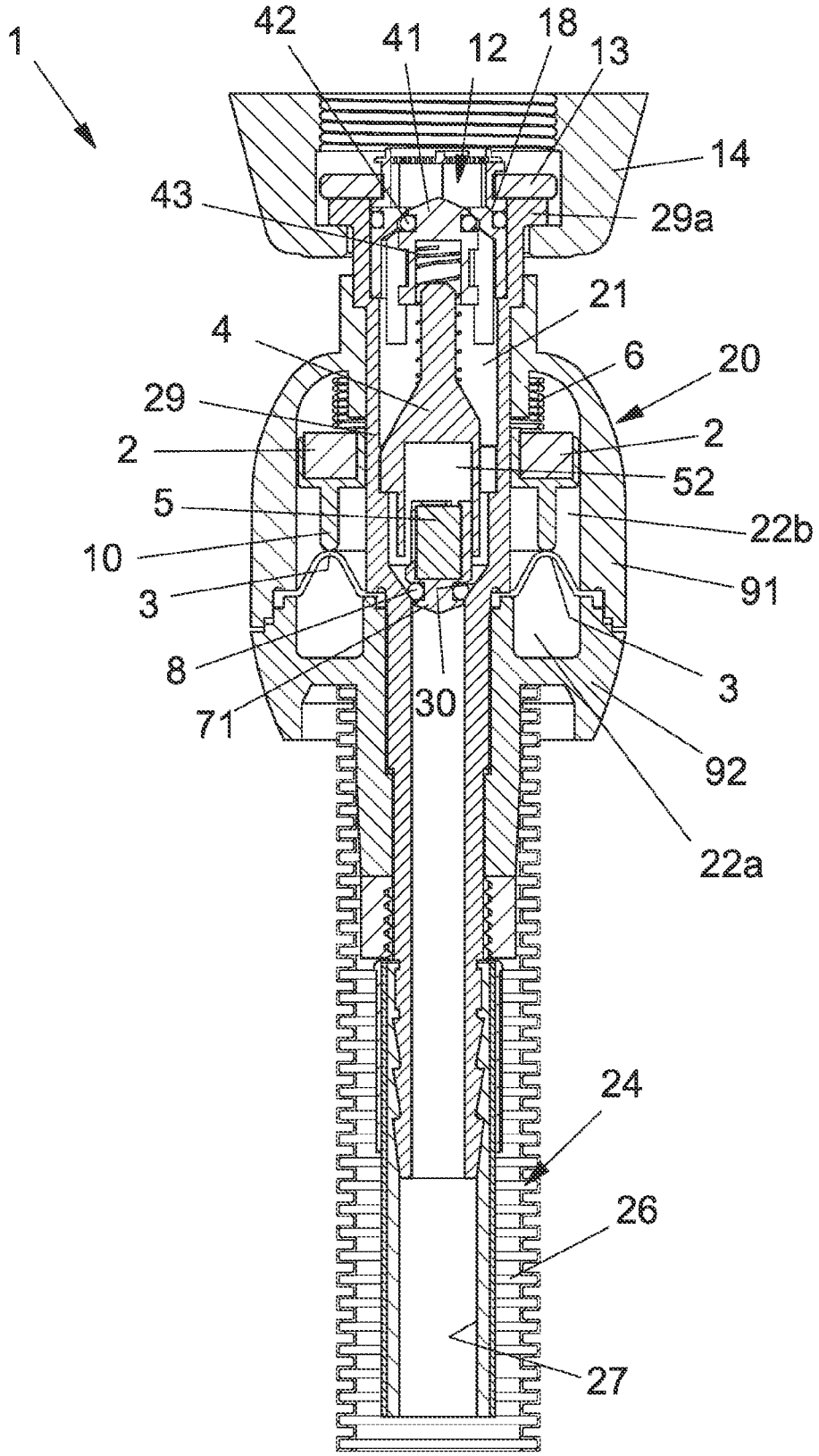
FIG. 5 is an elevation view, sectioned along the plane II-II of FIG. 1, illustrating the valve assembly in the condition of inner mechanism activated and water flow blocked.
Figure 6:
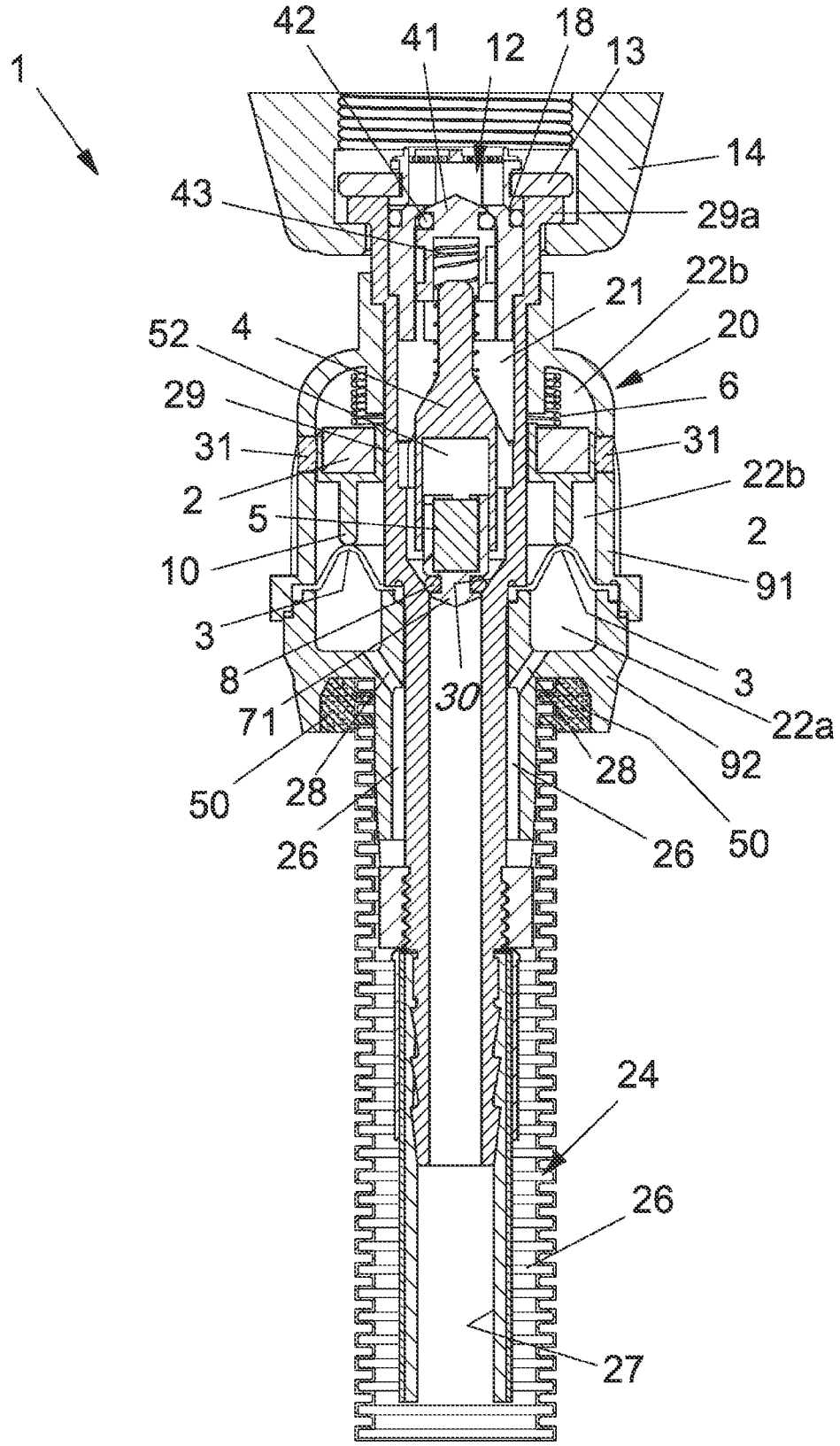
FIG. 6 is an elevation view, sectioned along the plane IV-IV of FIG. 3, illustrating the valve assembly in the condition of inner mechanism activated and water flow blocked.

If there is a leak of water from the hose 27, the air and water pressure that is created in the gap 26 passes through the passage holes 28 in the shell and inflates the membrane 3 which rises to a position shown in FIGS. 5 and 6.

The movement of the membrane 3 raises the annular support 10 and consequently the annular magnet 2, overcoming the pressure of the spring 6.

In the new position, the circular magnet 2, exploiting the opposing magnetic field, pushes the cylindrical magnet 5, housed in the plug 7, to the opposite side.

This movement causes the plug 7 to slide through the valve guide 4 so that the O-ring 8, mounted on the plug 7, abuts on the inclined surface 30 and interrupts the water flow.

In this situation, the annular support 10, which is advantageously colored in an evident way, for example red, is located in front of the windows 31, formed on the valve body 20, so that it is obvious that the inner mechanism is activated and that the water flow is blocked.

It has been found in practice that this invention accomplishes the intended aim and objects.

In fact, a more functional and compact safety valve assembly compared to known safety devices has been provided.

The water flow rate of this valve assembly, when it is in the normal operating position, is significantly higher than the flow rate of conventional devices.

Furthermore, according to the present invention, when the mechanism intervenes, it blocks the water flow even while the water is still flowing, which was not possible in conventional devices.

Intervention of the mechanism according to the present invention is repeatable and this allows the possibility of testing completely (100%) the valve assembly.

The number of components in this valve assembly is smaller than in conventional devices, which makes the present valve assembly more economical.

The assembly system is also simpler than in conventional devices, as a result of which the automation is less complicated, entirely to the advantage of the production economy.

The improved safety valve assembly according to the present invention offers a considerable improvement in terms of assembly of the components, thus reducing the overall dimensions.

An important advantage is the system of fixing the corrugated polypropylene sheath to the valve shell, by injection of plastic material through co-molding.

A further important advantage is the fixing system of the filter 12 which intersects with the upper valve guide 18 and engages by interlocking, forming a slot which becomes the seat housing the flat gasket 13, forming a single piece which is then inserted in the valve body under mechanical force.

A further important advantage is provided by the non-return valve, consisting of the check valve 41 with O-ring 42 and spring 43, which allows the incoming fluid to pass freely while it blocks, by sealing on the inclined surface of the upper valve guide 18, the fluid inside the valve and consequently in the inlet hose.

Naturally the materials used, as well as the dimensions, may be adapted to suit any needs.

The invention claimed is:

1. Safety valve assembly for water inlet hoses of washing machines and dishwashers, of the type comprising a valve body (20) formed by an upper half-shell (91) and a lower half-shell (92), an inner shank (29) equipped with an upper part (29*a*) provided at a ring nut (14) for fixing to the water inlet faucet and a lower valve guide (4), wherein an axial chamber (21) is formed between the lower valve guide (4) and said shank (29) and wherein an annular chamber (22) is formed between the shank (29) and said half-shells (91, 92), a membrane (3) being provided to divide said annular chamber (22) into an upper compartment (22*b*) and a lower compartment (22*a*), a filter (12) being further arranged at said upper portion (29*a*) of the shank (29), coupled by interlocking to a respective upper valve guide (18), said filter (12) being provided with a filtering part (53) and with axial feet (54*a*, 54*b*, 54*c*), each provided with a respective seat (55*a*, 55*b*, 55*c*), characterized in that said upper valve guide (18), at its attachment to the filter (12), has feet (56*a*, 56*b*, 56*c*), also bearing seats (57*a*, 57*b*, 57*c*), which, in the coupled condition of the upper valve guide (18) with the filter (12), form, together with the corresponding seats (55*a*, 55*b*, 55*c*) of the filter (12), a slot (58) suitable for receiving a gasket (13) in the coupling position of the filter (12) and the upper valve guide (18).

2. Valve assembly according to claim 1, characterized in that it further comprises a water inlet hose (27), on the outside of which a sheath (24) is arranged, wherein an injection of plastic material (50) is provided inside the interstices (51) formed between the outer surface of said sheath (24) and the inner wall of said lower half-shell (92), so as to achieve the hermetical sealing between the latter and the sheath (24) itself.

3. Valve assembly according to claim 1, characterized in that it provides a non-return valve arranged on said upper part (29*a*) of the shank (29), wherein said non-return valve comprises a plug (41) which closes on the mouth (59) of the water inlet valve guide (18).

4. Valve assembly according to claim 3, characterized in that said non-return valve further comprises a spring (43) which pushes the plug (41) to the closing position of said mouth (59).

5. Valve assembly according to claim 4, characterized in that said non-return valve further comprises an O-ring (42) on said plug (41).

6. Valve assembly according to claim 1, characterized in that said water inlet hose (27) defines a gap (26) with said sheath (24) and is in communication with said axial chamber (21) of said valve body (20), said gap (26) being in communication with said annular chamber (22) by means of fluid passage holes (28) formed in said lower shell (92), there also being in said annular chamber (22) an annular magnet (2) housed in an annular support (10) and axially movable in opposition to a spring (6), due to the thrust of a membrane (3) arranged in the side of the annular chamber (22) in communication with said holes (28), said spring (6) being mounted coaxially to an inner shank (29) of said valve body (20), said inner shank (29) of said valve body (20) defining, internally, said axial chamber (21) and, externally, said annular chamber (22), said membrane (3) dividing said annular chamber (22) into two separate compartments, a lower compartment (22*a*) in communication with said gap (26) through said fluid passage holes (28), and an upper compartment (22*b*) provided with transparent windows (31), in said axial chamber (21), inside said shank (29), there also being a plug (7) which slides axially and has a mushroom head (71) capable of closing the passage of fluid into said axial chamber (21), at a narrowing defined by an inclined surface (30) of said axial chamber (21), a cylindrical magnet (5) being housed in a cylindrical seat of said plug which slides in a valve guide (4).

7. Safety valve assembly, according to claim 6, characterized in that said corrugated sheath (24) is made of polypropylene, said lower shell (92) being made of polypropylene and fiber.

* * * * *